US006604340B2

(12) United States Patent
Liao

(10) Patent No.: US 6,604,340 B2
(45) Date of Patent: Aug. 12, 2003

(54) SIDE SEALING DEVICE OF PACKAGING MACHINE INCORPORATING SEALING LINE ADJUSTING MECHANISM

(75) Inventor: Jonathan I. N. Liao, Taipei (TW)

(73) Assignee: Benison & Co., Ltd., Taipei (TW)

( * ) Notice: Subject to any disclaimer, the term of this patent is extended or adjusted under 35 U.S.C. 154(b) by 131 days.

(21) Appl. No.: 09/845,194

(22) Filed: May 1, 2001

(65) Prior Publication Data

US 2002/0170268 A1 Nov. 21, 2002

(51) Int. Cl.[7] ..... B65B 51/10

(52) U.S. Cl. ..... 53/373.7; 53/374.3; 53/375.6; 53/562; 53/568

(58) Field of Search ..... 53/373.5, 373.7, 53/374.3, 374.6, 374.8, 375.6, 562, 568

(56) References Cited

U.S. PATENT DOCUMENTS 3,552,088 A * 1/1971 Akiro ..... 53/450
4,548,018 A * 10/1985 Wojnicki ..... 53/51
5,001,884 A * 3/1991 Hanagata ..... 53/58
5,134,835 A * 8/1992 Walkiewicz et al. ..... 53/568
5,282,349 A * 2/1994 Siegel ..... 53/433
5,444,964 A * 8/1995 Hanagata ..... 53/550
5,603,801 A * 2/1997 DeFriese et al. ..... 156/515
5,761,878 A * 6/1998 Walkiewicz et al. ..... 53/373.5
5,956,931 A * 9/1999 Stork ..... 53/550

* cited by examiner

*Primary Examiner*—Rinaldi I. Rada
*Assistant Examiner*—Hemant M. Desai
(74) *Attorney, Agent, or Firm*—Rosenberg, Klein & Lee

(57) ABSTRACT

A packaging machine for packaging an article having a lateral side along which a sealing line is formed by heat sealing operation is disclosed. The packaging machine includes a machine frame having transversely-extending rails on which a conveyor for carrying the article and a package film for packaging the article is movably supported whereby the conveyor and thus the article and the package film are transversely position-adjustable. A side sealing device includes a film forwarding device for synchronously moving the package film with the article in a longitudinal direction. A position-adjusting device comprises a support structure attached to the conveyor to be transversely position-adjustable. A movable chassis is movably coupled to the support structure by means of a screw rod whereby rotation of the screw rod moves the chassis with respect to the support structure in a vertical direction. A heat sealing blade is supported on the chassis by an actuation device to be reciprocally movable between an extending position for performing heat sealing operation on an edge of the package film along the side of the article to form the sealing line and a retracted position. The heat sealing blade is movable with the chassis for adjusting the position with respect to the article in the vertical direction.

11 Claims, 11 Drawing Sheets

SIDE SEALING DEVICE OF PACKAGING MACHINE INCORPORATING SEALING LINE ADJUSTING MECHANISM

FIELD OF THE INVENTION

The present invention generally relates to a packaging machine with heat sealing device for packaging articles with heat sealing film, and in particular to a packaging machine capable to accommodate different sizes of articles to be packaged.

BACKGROUND OF THE INVENTION

Package films made of plastics or other heat sealable materials are widely used in packaging a variety of products, such as foods, compact disks for computer software and music and books, to protect the products from being damaged or contaminated. In a packaging process, a package film is placed around an article to be packaged. Edges of the package film is then heated to seal along sides of the article. Thus, an important factor that influences the productivity of a packaging line is the heat sealing operation performed by a packaging machine.

A conventional packaging machine forms an L-shaped sealing line along two adjacent sides of an article to be packaged. In other words, it seals two sides simultaneously. However, the operation of the packaging machine is intermittent. The productivity is limited. Furthermore, articles to be packaged may have variable sizes and shapes. This causes deficiency in final package made by the conventional packaging machine. For example, as shown in FIGS. 11 and 12, due to different thickness (dimension in a vertical direction) of the article to be packaged, a sealing line A or A' may not be located midway of the thickness of an article B. They may be below (sealing line A) or above (sealing line A') the middle line. Such a situation may cause certain problems. For example, the sealing line may not be properly formed or the package film be damaged or undesired over-packaging be caused. Eventually, the quality of the products is negatively affected.

In a packaging line, articles to be packaged are usually transported by a conveyor system in a longitudinal direction. One way to accommodate articles of different thickness (vertical dimension) to a particular packaging machine is to change the vertical position of the conveyor belt with respect to the packaging machine. This is, however, difficult and ineffective. Modifying a conveyor system to suit for different articles is also very impractical because the packaging line may sometimes constitute only a part of a complete manufacturing line. Changing the conveyor system for the packaging line may cause serious problem to the other portions of the same manufacturing line.

Another disadvantage associated with the above-discussed conventional packaging machine is that the L-shaped sealing line formed by the packaging machine is subject to limitation of size of the particular packaging machine. For articles having elongate lateral side dimension, it is difficult to package the articles with regular packaging machines that forms L-shaped sealing lines.

SUMMARY OF THE INVENTION

Accordingly, an object of the present invention is to provide a packaging machine comprising a sealing line adjusting device for adjusting the sealing line with respect to the size of an article to be packaged.

Another object of the present invention is to provide a packaging machine comprising a side sealing device for continuously forming sealing lines along sides of articles.

A further object of the present invention is to provide a packaging machine comprising a side sealing device for forming a side sealing line without causing damage to the package or the package film.

A still further object of the present invention is to provide a packaging machine comprising a side sealing device for forming a continuous side sealing line of unlimited length.

To achieve the above objects, in accordance with the present invention, there is provided a packaging machine for packaging an article having a lateral side along which a sealing line is formed by heat sealing operation. The packaging machine comprises a machine frame having transversely-extending rails on which a conveyor for carrying the article and a package film for packaging the article is movably supported whereby the conveyor and thus the article and the package film are transversely position-adjustable. A side sealing device comprises a film forwarding device for synchronously moving the package film with the article in a longitudinal direction. A position-adjusting device comprises a support structure attached to the conveyor to be transversely position-adjustable. A movable chassis is movably coupled to the support structure by means of a screw rod whereby rotation of the screw rod moves the chassis with respect to the support structure in a vertical direction. A heat sealing blade is supported on the chassis by an actuation device to be reciprocally movable between an extending position for performing heat sealing operation on an edge of the package film along the side of the article to form the sealing line and a retracted position. The heat sealing blade is movable with the chassis for adjusting the position with respect to the article in the vertical direction.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 2:
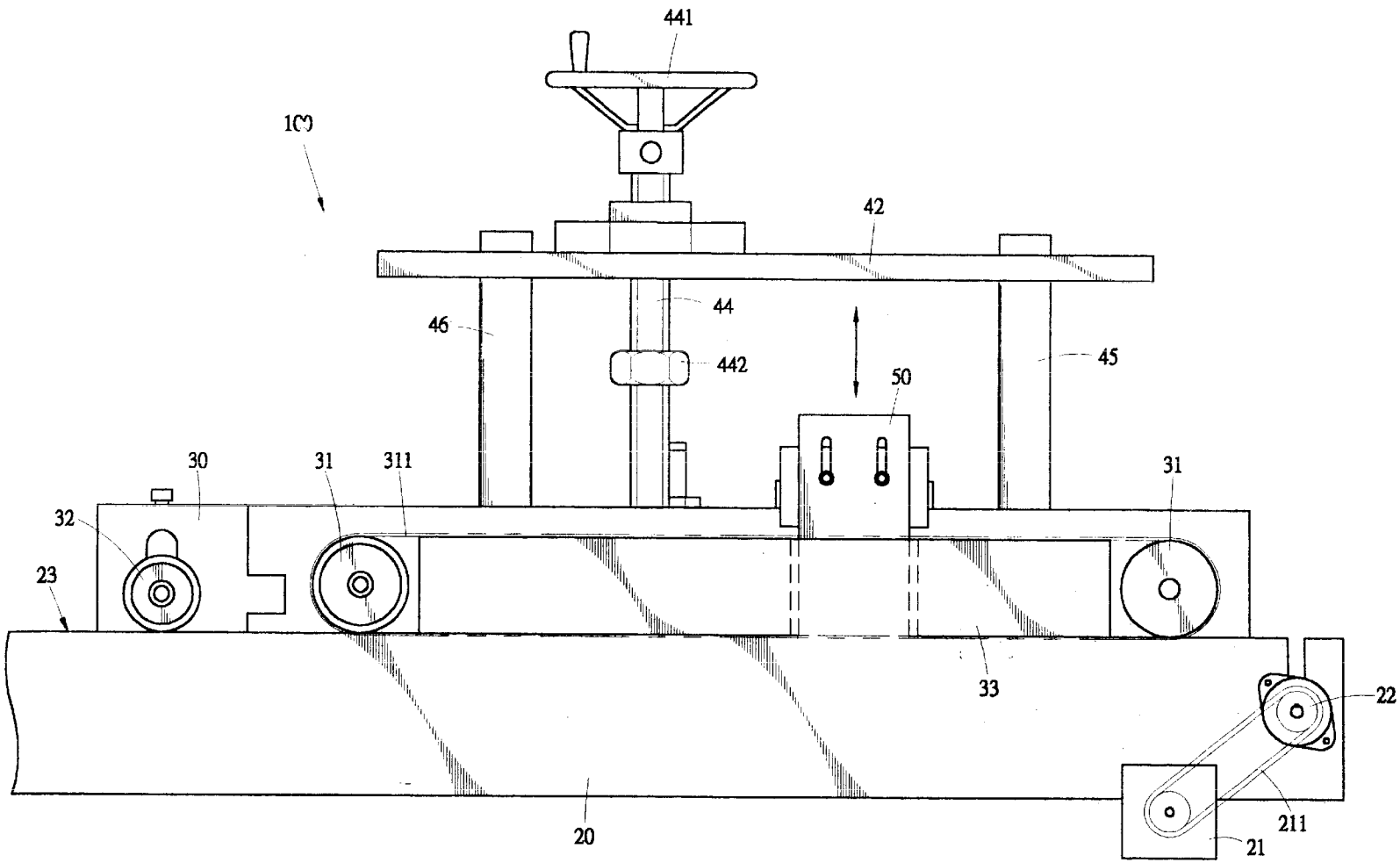
FIG. 2 is a side elevational view of the side sealing device, together with a conveyance device, of the packaging machine of the present invention.
Figure 3:
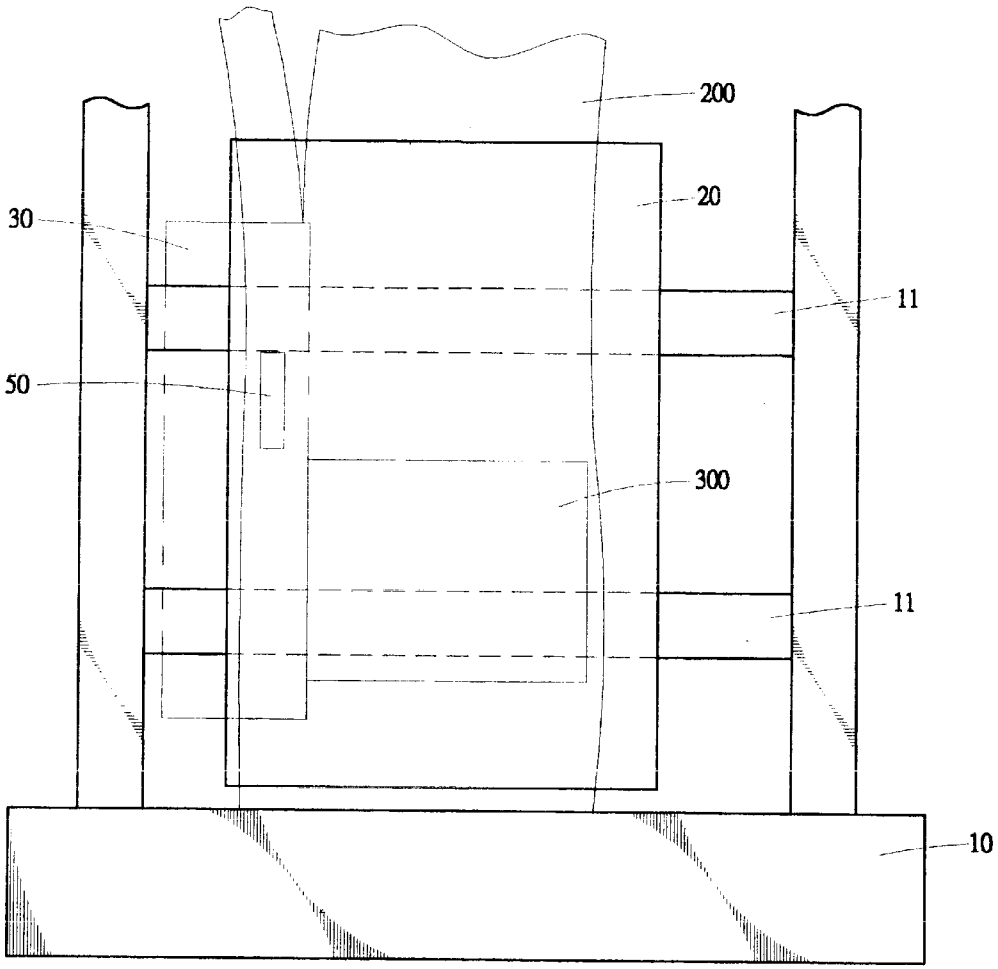
FIG. 3 is a top view of the packaging machine of the present invention.
Figure 4:
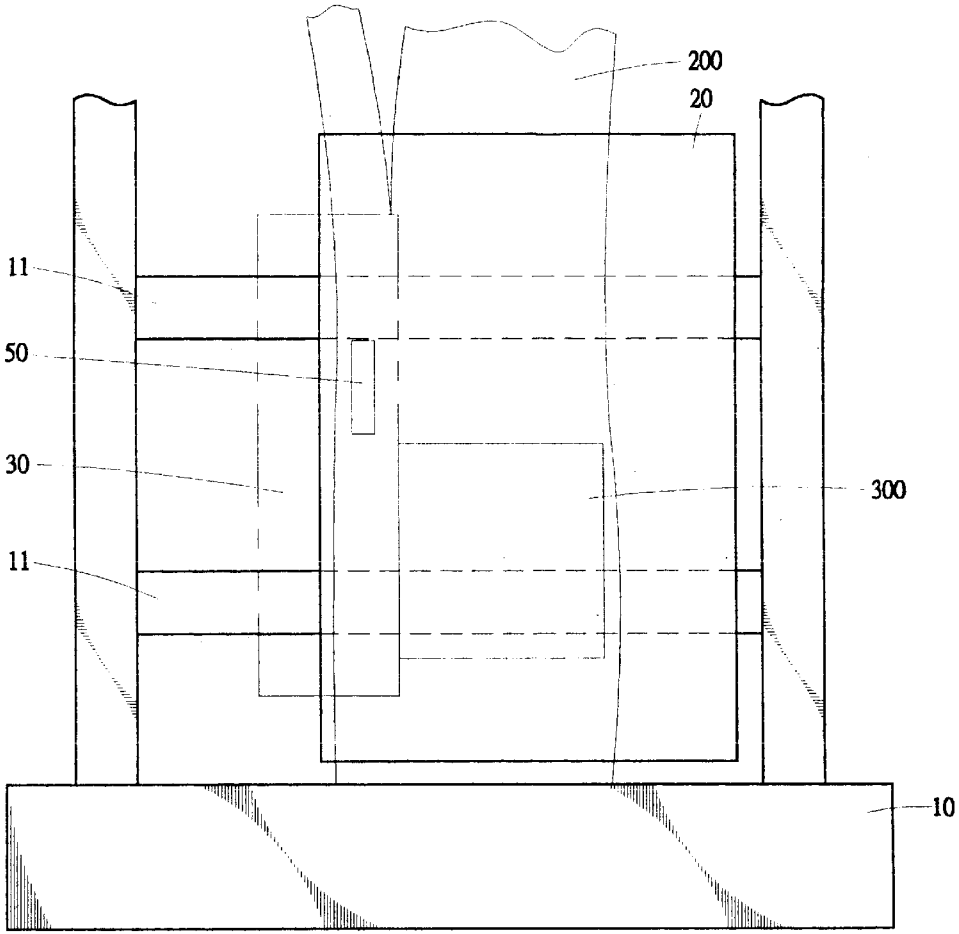
FIG. 4 is similar to FIG. 3, showing transverse movement of the conveyance device with respect to a machine frame of the packaging machine.

With reference to the drawings and in particular to FIGS. 2–4, a packaging machine in which a side sealing device in accordance with the present invention is incorporated is shown. The packaging machine comprises a machine frame 10 having a plurality of rails 11 extending in a transverse direction to support a conveyance system 20. The conveyance system 20 may comprise conveyor of be any known type, such as belt or chain conveyor. In the embodiment illustrated, the conveyance system 20 is operated by a power driving device 21, including for example an electrical motor having an output spindle (not labeled) mechanically coupled by a chain 211 to a shaft 22 for driving a conveyor belt 23. The conveyor belt 23 carries and transports, in a longitudinal direction, an article 300 to be packaged and a package film 200 which will be wrapped around the article 300. The conveyor 20 is movable along the rails 11 in the transverse direction for accommodating articles 300 of different sizes and package film 200 of different width.

Figure 1:
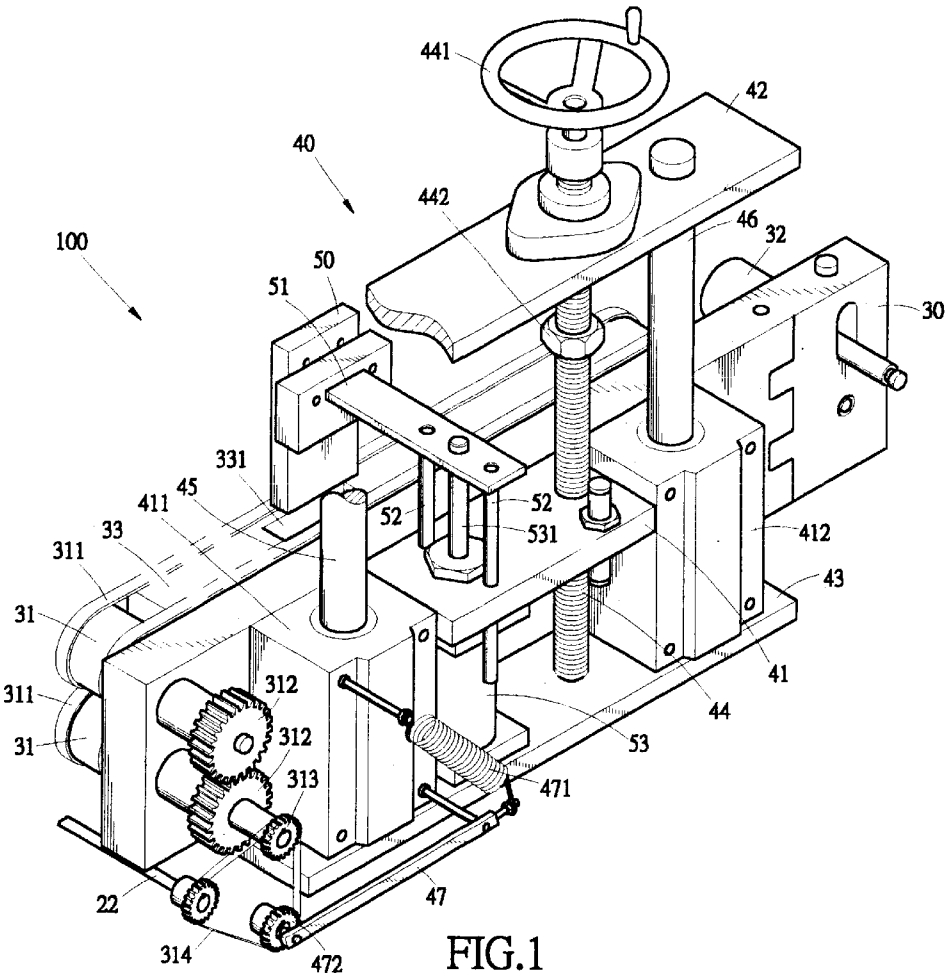
FIG. 1 is a perspective view, partially broken, of a side sealing device of a packaging machine constructed in accordance with the present invention.

Also referring to FIG. 1, the side sealing device constructed in accordance with the present invention, generally designated with reference numeral 100, comprises a base plate 30 separated from and thus movable with respect to the conveyor 20. A film forwarding device is attached to the base plate 30, comprising two pairs of guide rollers 31 and a pair of driving rollers 32 mounted on a front surface (not labeled) of the base plate 30. The guide rollers 31 are mechanically coupled to each other by belts 311 so that they are rotatable in unison with each other. A pair of mated gears 312 are arranged on a rear side (not labeled) of the base plate 30 and co-axially fixed to the guide rollers 31 so that the gears 312 are rotatable with the guide rollers 31. A first pinion 313 is co-axially fixed to the shaft of one of the guide wheels 31. The first pinion 313 is mechanically coupled to a second pinion (not labeled) mounted on the shaft 22 of the conveyor 20 by a timing belt 314 whereby the guide rollers 31, the gears 312 and the pinions 313 are rotatable in synchronization with each other by being driven by the driving device 21. The operation of the guide rollers 31 and the conveyor 20 is thus kept synchronous. Quite obviously, the pinion-timing belt pair may be replaced by sprocket-chain pair.

Figure 5:
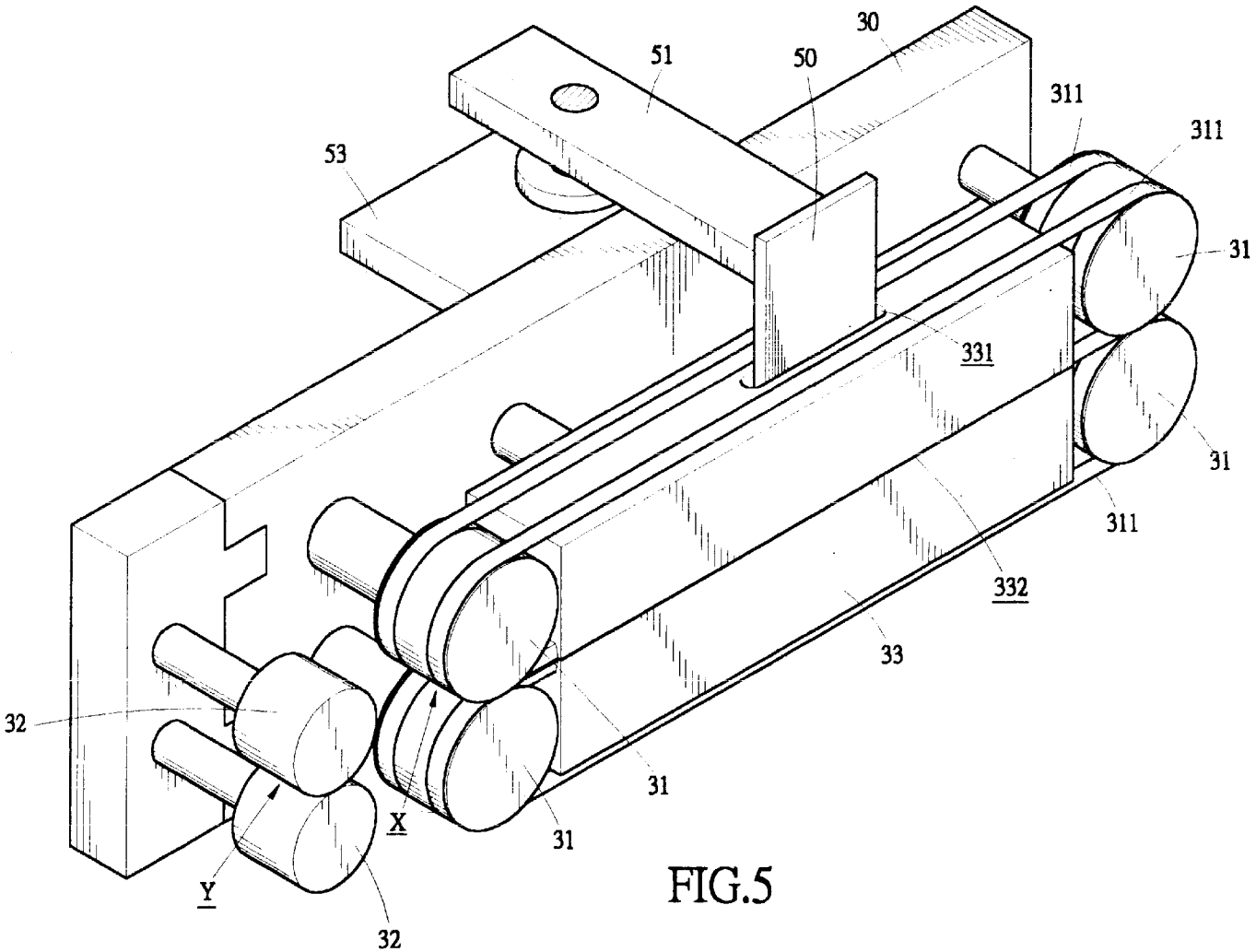
FIG. 5 is a perspective view of a portion of the side sealing device viewed from a different perspective.
Figure 6:
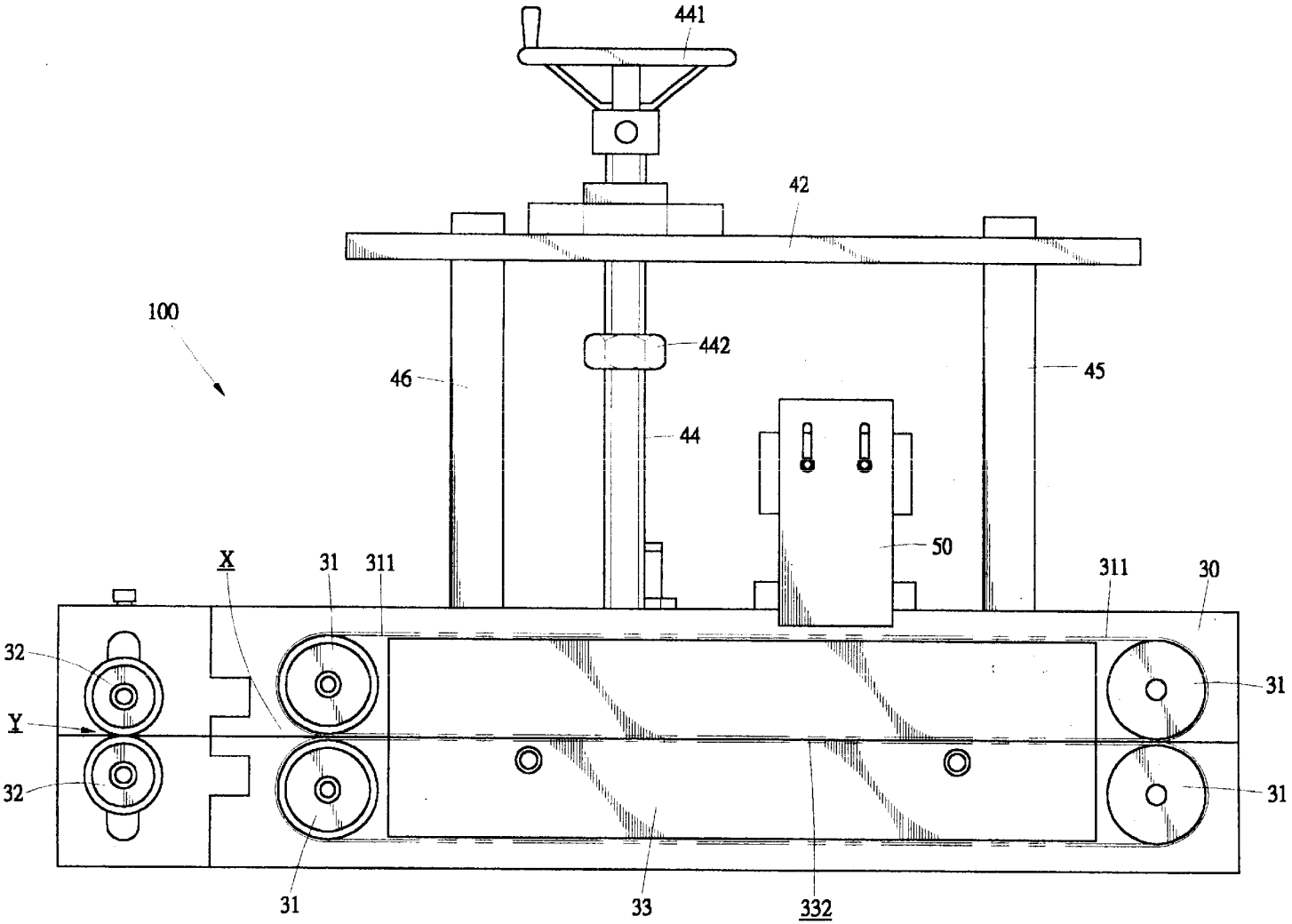
FIG. 6 is a front side elevational view of FIG. 1.

Also referring to FIGS. 5 and 6, gaps X and Y are formed between each pair of guide rollers 31 and the driving rollers 32 to allow an edge of the package film 200 to pass therethrough. The gaps X and Y are sized to frictionally engage the edge of the package film 200 for driving the package film 200 forward in the longitudinal direction whereby the package film 200 may move in synchronization with the conveyor belt 23 of the conveyor 20.

A shielding member 33 in the form of a box is disposed between the guide roller pairs 31. A slit 332 is defined in a side wall of the shielding member 33 and extends between the guide roller pairs 31 forming a passage for the package film 200. An opening 331 is defined in a top side of the shielding member 33, forming an entrance for a heat sealing blade 50 to allow the heat sealing blade 50 to approach, contact and heat-seal the edge of the package film 200 along one side of the article 300. A sealing line is thus formed along the side of the article 300.

Figure 7:
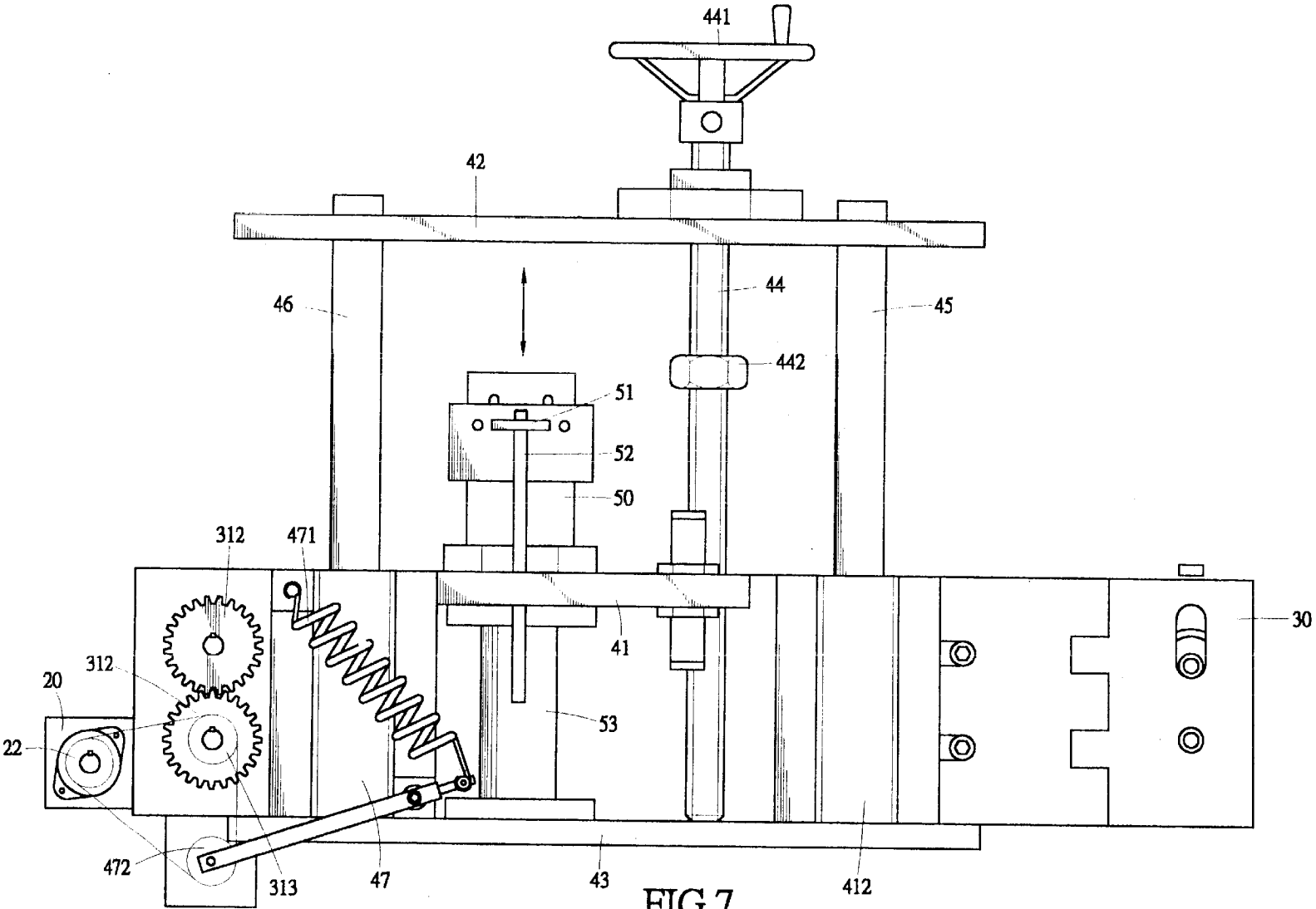
FIG. 7 is a rear side elevational view of FIG. 1.
Figure 8:
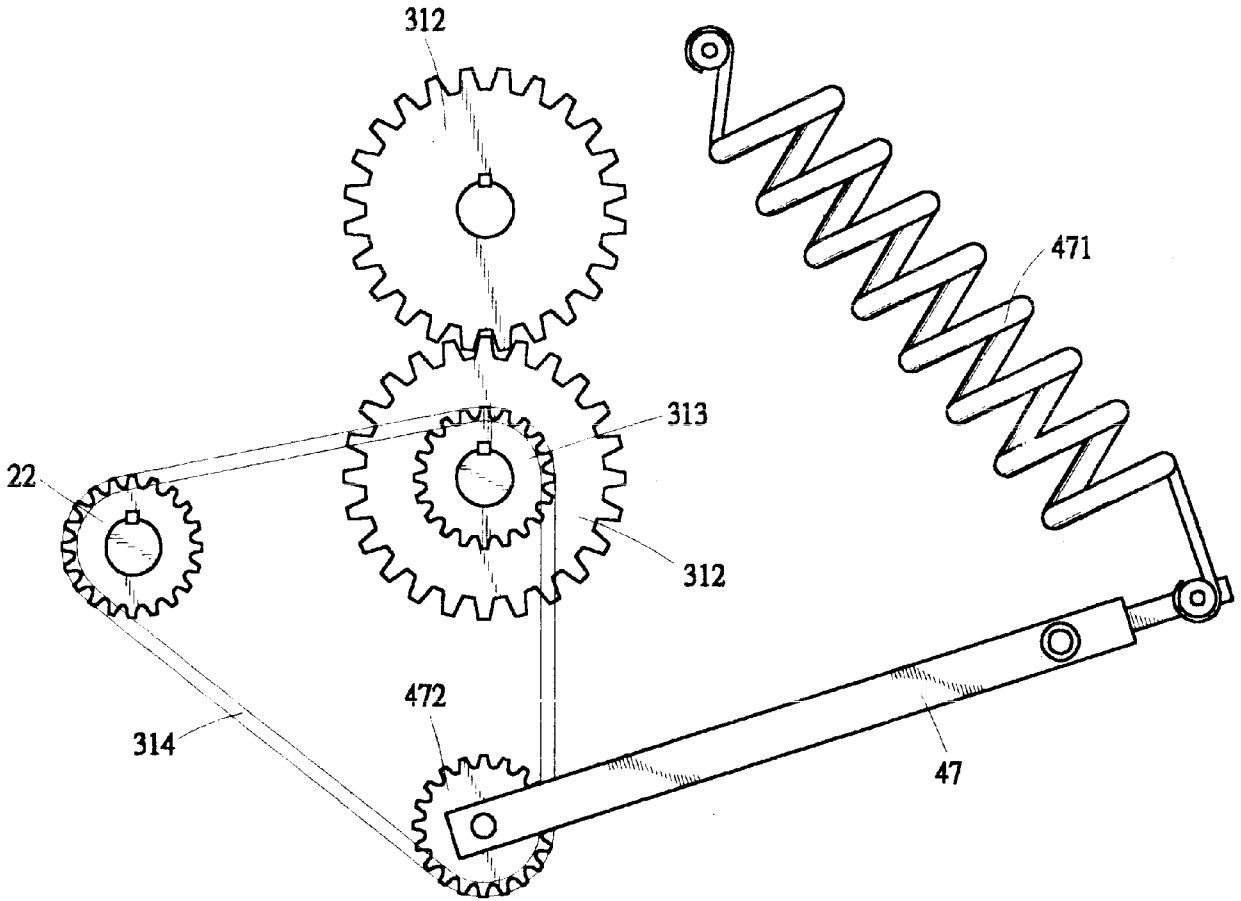
FIG. 8 is a schematic view showing a device for maintaining proper torque transmitted between the conveyance device and the film forwarding device of the packaging machine of the present invention.

Also referring to FIGS. 7 and 8, a position adjusting device 40 comprises a movable chassis 41 fixed to the rear face of the base plate 30. Two blocks 411, 412 are arranged on opposite sides of the chassis 41 and are fixed to the rear face of the base plate 30. A support structure comprises upper and lower support plates 42, 43 respectively arranged above and below the chassis 41 and the blocks 411, 412 and two guide posts 45, 46 extending between the support plates 42, 43. The lower support plate 43 are attached to the conveyor 20. The guide posts 45, 46 extend through bores (not labeled) defined in the blocks 411, 412 for guiding movement of the blocks 411, 412, as well as the chassis 41 and the base plate 30, with respect to the lower support plate 43 and thus the conveyor 20 in a vertical direction.

An operating device comprises a screw rod 44 extending from the upper support plate 42 to the lower support plate 43 and rotatably supported by the upper and lower support plates 42, 43. The screw rod 44 threadingly engages an inner-threaded hole (not labeled) defined in the chassis 41 whereby when the screw rod 44 is rotated, the chassis 41 is linearly moved in the vertical direction, by being guided by the posts 45, 46, with respect to the upper and lower support plates 42, 43 and thus the conveyor 20. Thus, the position of the side sealing device 100 with respect to an article 300 carried by the conveyor belt 23 is adjusted as indicated by arrows of FIGS. 2 and 7. This allows the vertical position of a side sealing line with respect to the thickness of the article 300 to be changed by moving the chassis 41 with respect to the conveyor 20.

A hand wheel 441 is mounted to the screw rod 44 above the upper support plate 42 for manual rotation of the screw rod 44. The hand wheel 441 can be replaced by other power driving devices, such as electrical motor and pneumatic or hydraulic device. At least a stop member 442 is attached to the screw rod 44 for limiting the linear movement of the chassis 41 with respect to the support plates 42, 43. In the embodiment illustrated, the stop member 442 comprises a nut threadingly engaging the screw rod 44. It is understood that the nut can be replaced by other suitable means.

As best shown in FIG. 8, the position adjusting device 40 comprises means for preventing the chain 314 from loosening during the positional adjustment of the chassis 41 with respect to the conveyor 20. A bar 47 is pivotally mounted to the block 411 having first and second ends on opposite sides of the pivot point. A third pinion or sprocket 472 is rotatably supported on the first end of the bar 47 and engaging the timing belt or chain 314 whereby the first, second and third pinions or sprockets 313, 472 and the timing belt or chain 314 form a triangle with the pinions or sprockets located at the corners of the triangle. A biasing member 471, such as a helical spring, is connected between the second end of the bar 47 and the block 411 for mechanically biasing the bar 47 in such a way to keep a desired tension on the timing belt or chain 314. Maintaining the desired level of tension on the timing belt or chain 314 allows the rotational movement of the shaft 22 of the driving device 21 to be effectively and stably transmitted to the first pinion 313 and thus the guide wheels 31 for driving the package film 200 forward in synchronization with the conveyor 20.

The heat sealing blade 50 can be of any type as long as it is capable to effectively heat sealing the package film 200 and forming a sealing line along the side of the article 300. The heat sealing blade 50 is supported by an arm 51 (FIG. 1). An actuation device 53, such as a solenoid and a pneumatic cylinder, is mounted to the chassis 41 and has an elongate driving rod 531 that is capable to move with respect to the chassis 41 by being driven by the actuation device 53 between extended and retracted positions. The arm 51 is fixed to the driving rod 531 whereby the heat sealing blade 50 is movable with the chassis 41 when the driving rod 531 is kept fixed during the adjustment of the position of the chassis 41 with respect to the conveyor 20. When the actuation device 53 is activated, the driving rod 531 moves the heat sealing blade 50, via the arm 51, into and out of the shielding member 33 for engaging and sealing the package film 200. In the embodiment illustrated, when the driving rod 531 is moved to the retracted position, the heat sealing blade 50 is moved into the shielding member 33 to contact and thus heat-seal the edge of the package film 200 and when the driving rod 531 is moved to the extended position, the heat sealing blade 50 is moved out of the shielding member 33 and thus separated from the package film 200.

Two guide rods 52 are provided on opposite sides of the driving rod 531 and extend through holes (not labeled) defined in the arm 51 for guiding the movement of the heat sealing blade 50.

Figure 9:
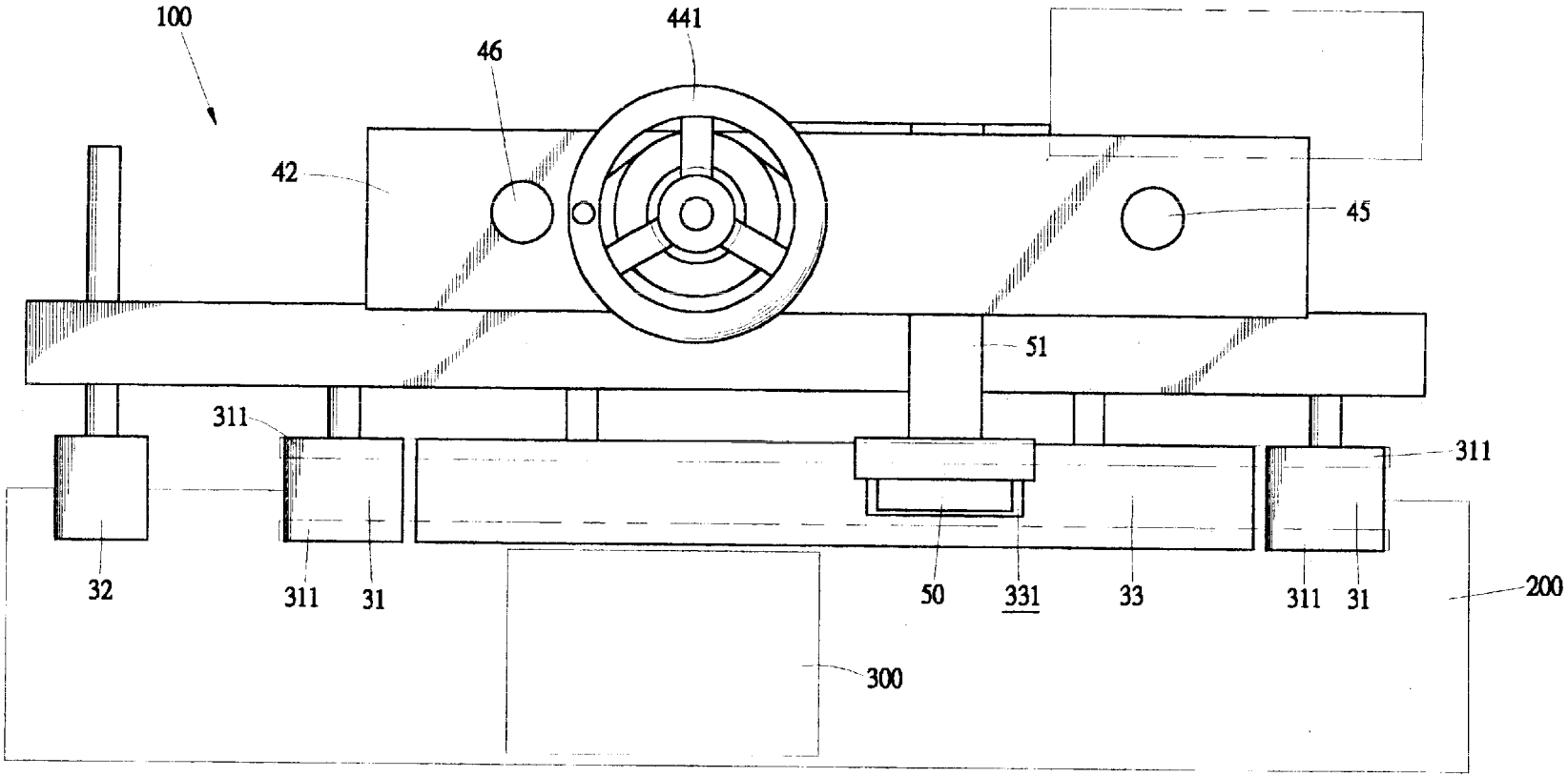
FIG. 9 is a top view showing an article is packaged with a package film by the packaging machine of the present invention.
Figure 10:
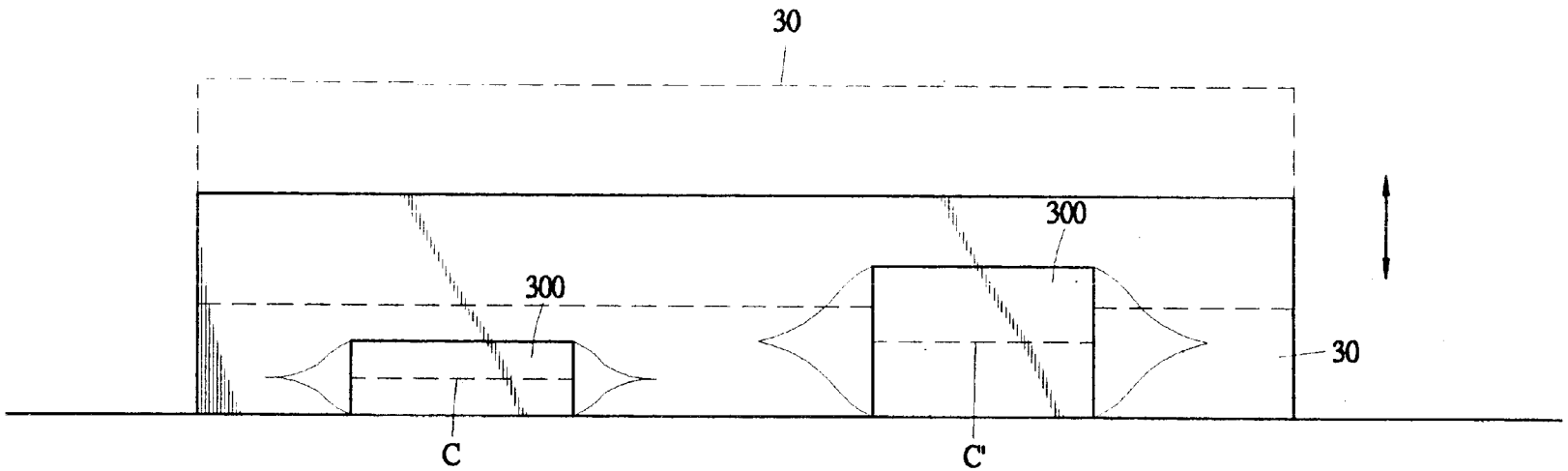
FIG. 10 is a schematic view showing the adjustment of the vertical position of the side sealing device of the present invention.
Figure 12:
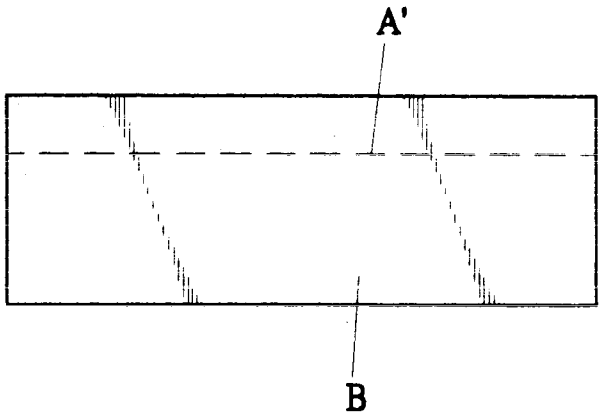
FIGS. 11 and 12 are schematic views showing sealing lines formed by a conventional packaging machine located below and above middle line of the thickness of an article.
Figure 11:
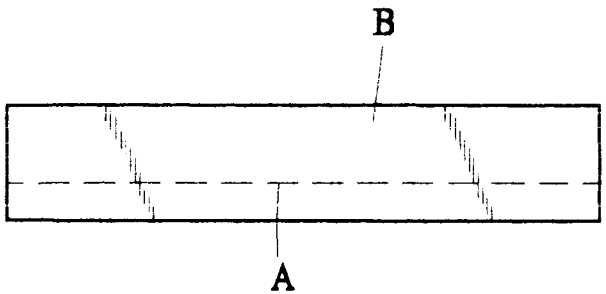

Also referring to FIGS. 9 and 10, when the article 300 is carried and moved by the conveyor 20 (not shown in FIGS. 9 and 10), the package film 200 is synchronously driven by the guide rollers 31 and the driving rollers 32 of the side sealing device 100. The heat sealing blade 50 is operated by the actuation device 53 to continuously form a sealing line along one side of the article 300. By moving the conveyor 20 and the side sealing device 100 with respect to the machine frame 10 along the rails 11, articles 300 of different width can be accommodated in the packaging machine and by operating the hand wheel 411, the position of the side sealing device 100 with respect to the article 300 is adjusted, thus forming sealing line at proper position along one side of the article 300. In other words, the position of the sealing line with respect to the article 300 is adjustable by operating the hand wheel 411, such as lines C and C' of FIG. 10. Thus articles of different width and different thickness can be properly packaged by means of the packaging machine incorporating the side sealing device of the present invention.

Although the present invention has been described with reference to the preferred embodiment thereof, it is apparent to those skilled in the art that a variety of modifications and changes may be made without departing from the scope of the present invention which is intended to be defined by the appended claims. For example, an independent driving device may be adapted to independently drive the guide wheels 31. The shielding member 33 may be removed without substantially affecting the operation of the packaging machine. The hand wheel 441 may be replaced by an electrical motor. Furthermore, if desired, the guide rollers 31 and the driving rollers 32 may be omitted and the package film can be directly driven by a heat sealing mechanism that is different from the blade described herein.

What is claimed is:

1. A packaging machine comprising:

a machine frame comprising rails;

a conveyance device movable along the rails and comprising a transportation belt driven by a driving device having a rotatably driven shaft, the transportation belt being adapted to carry and move an article forward; and a side sealing device comprising:

a film forwarding device comprising a plurality of roller pairs adapted to continuously pass an edge of a package film therebetween and drive the package film forward in synchronization with the transportation belt, a pair of meshingly engaged gears respectively coaxially coupled to one of the pair of rollers, and a first pinion gear coaxially mounted to one of the pair of gears and coupled to a second pinion gear coupled to the shaft of the driving means by a chain;

a position adjusting device comprising a support structure attached to the conveyance device, a chassis coupled to an operating device to be selectively moved with respect to the support structure, the film forwarding device being mounted to and movable with the chassis for adjusting relative position of the film forwarding device with respect to the conveyance device, the position adjusting device including (a) a bar pivotally coupled to the film forwarding device, (b) a third pinion gear rotatably mounted to one end of the bar and engaged with the chain, and (c) a spring coupled to the bar to maintain the chain in tensioned engagement with the first, second, and third pinion gears through out the movement of the film forwarding device; and a heat sealing device comprising an actuation device mounted to the chassis, a heat sealing member attached to and selectively moved by the actuation device between a first position where the heat sealing member contacts and thus heat-seals the edge of the package film and a second position where the heat sealing member is moved away from the package film.

2. The packaging machine as claimed in claim 1, wherein the driving device comprises a motor.

3. The packaging machine as claimed in claim 1, wherein the roller pairs are mechanically coupled together by belts.

4. The packaging machine as claimed in claim 1, wherein the side sealing device comprises a shielding member defining an opening into which the heat sealing member is movable.

5. The packaging machine as claimed in claim 4, wherein the shielding member defines a slit through which the film passes.

6. The packaging machine as claimed in claim 1, wherein the actuation device comprises a driving rod to which an arm is fixed, the heat sealing member being attached to the arm to be movable therewith.

7. The packaging machine as claimed in claim 6, wherein guide rods are formed on the chassis and extend through holes defined in the arm for guiding the movement of the heat sealing member.

8. The packaging machine as claimed in claim 1, wherein the actuation device comprises a solenoid.

9. The packaging machine as claimed in claim 1, wherein the actuation device comprises a pneumatic cylinder.

10. A packaging machine comprising:

a machine frame comprising rails;

a conveyance device movable along the rails and comprising a transportation belt adapted to carry and move an article forward; and a side sealing device comprising:

a film forwarding device comprising a plurality of roller pairs adapted to continuously pass an edge of a package film therebetween and drive the package film forward in synchronization with the transportation belt;

a position adjusting device comprising a support structure attached to the conveyance device, a chassis coupled to an operating device to be selectively moved with respect to the support structure, the film forwarding device being mounted to and movable with the chassis for adjusting relative position of the film forwarding device with respect to the conveyance device, the operating device of the position adjusting device including (a) a screw rod rotatably supported on the support structure and threadingly engaging an inner-threaded hole defined in the chassis whereby rotating the screw rod causes the chassis to move with respect to the support structure, and (b) a stop member coupled to the screw rod to limit the movement of the chassis; and, a heat sealing device comprising an actuation device mounted to the chassis, a heat sealing member attached to and selectively moved by the actuation device between a first position where the heat sealing member contacts and thus heat-seals the edge of the package film and a second position where the heat sealing member is moved away from the package film.

11. The packaging machine as claimed in claim 10, wherein the stop member comprises a nut threadedly engaging the screw rod.

* * * * *